US009933154B2

(12) United States Patent
Ryan et al.

(10) Patent No.: US 9,933,154 B2
(45) Date of Patent: Apr. 3, 2018

(54) SYSTEM FOR PRODUCING HIGH PRESSURE STEAM FROM LOW QUALITY WATER

(71) Applicant: Babcock & Wilcox Power Generation Group, Inc., Barberton, OH (US)

(72) Inventors: Donald E Ryan, Diamond, OH (US); James S Kulig, Medina, OH (US); Larry A Pierson, Uniontown, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 228 days.

(21) Appl. No.: 14/298,381

(22) Filed: Jun. 6, 2014

(65) Prior Publication Data

US 2015/0007781 A1 Jan. 8, 2015

Related U.S. Application Data

(60) Provisional application No. 61/842,157, filed on Jul. 2, 2013.

(51) Int. Cl.
*F22B 1/16* (2006.01)

(52) U.S. Cl.
CPC ..... *F22B 1/16* (2013.01); *Y10T 137/3084* (2015.04)

(58) Field of Classification Search
CPC .... F28B 1/08; F28B 1/16; F28B 1/126; F28B 3/08; F28B 29/067; F28B 33/00; F28B 9/10
USPC ..... 122/32, 483
See application file for complete search history.

(56) References Cited

U.S. PATENT DOCUMENTS 3,240,675 A * 3/1966 Weber ..... F22B 1/08 122/451.1
3,247,830 A * 4/1966 Vogler ..... F22B 29/061 122/235.11
3,349,003 A * 10/1967 Kagi ..... F22B 1/08 122/406.1
3,369,971 A * 2/1968 Kagi ..... F22B 1/08 376/210
3,861,998 A * 1/1975 Okrent ..... G21C 1/22 376/206
4,370,949 A * 2/1983 Beckett ..... F22B 33/00 122/20 B
4,398,603 A * 8/1983 Rodwell ..... E21B 36/00 122/1 R
4,730,577 A * 3/1988 Houghton ..... F22B 37/22 122/33
4,745,757 A * 5/1988 Kim ..... F22D 11/00 60/39.182

(Continued)

*Primary Examiner* — Nathaniel Herzfeld
(74) *Attorney, Agent, or Firm* — Michael J. Seymour

(57) ABSTRACT

The present disclosure relates to a system for producing high pressure steam from low quality feedwater for a designated process. The system includes a first closed loop in fluid communication with a boiler and a heat exchanger assembly. A first fluid flows through the first closed loop, and is of acceptable quality for use in a boiler. Heat from the boiler is transferred to a second loop through the heat exchanger assembly. The second loop includes the low quality feedwater, which is converted to high pressure steam. The high pressure steam produced from the low quality water can be used in the designated process. This reduces corrosion/downtime in the boiler that might otherwise occur if the low quality water was directly heated by the boiler.

20 Claims, 3 Drawing Sheets

(56) References Cited

U.S. PATENT DOCUMENTS

| | | | | | |
|---|---|---|---|---|---|
| 4,961,311 | A * | 10/1990 | Pavel | F01K 9/02 | 60/39.182 |
| 2013/0161009 | A1 * | 6/2013 | Price | E21B 43/2406 | 166/303 |

* cited by examiner

SYSTEM FOR PRODUCING HIGH PRESSURE STEAM FROM LOW QUALITY WATER

CROSS-REFERENCE TO RELATED APPLICATIONS

This application claims priority to U.S. Provisional Application Ser. No. 61/842,157, filed Jul. 2, 2013 entitled "System for Producing High Pressure Steam from Low Quality Water". U.S. Provisional Application Ser. No. 61/842,157, filed Apr. 11, 2013 entitled "Dual System for Producing High Pressure Steam from Low Quality Water" is incorporated by reference herein in its entirety.

BACKGROUND

The present disclosure relates to systems and methods for producing high pressure steam using a poor or low quality feedwater source. This can be accomplished without continuously treating large quantities of water.

During combustion, the chemical energy in a fuel is converted to thermal heat inside the furnace of a boiler. The thermal heat is captured through heat-absorbing surfaces in the boiler to produce steam. The fuels used in the furnace include a wide range of solid, liquid, and gaseous substances, including coal, natural gas, and diesel oil.

Steam generation from a boiler system involves thermal and physical processes of heat transfer, fluid flow, evaporation, and condensation of a feedwater fluid mixture that includes water and steam. As the temperatures and pressures of the feedwater and the produced steam change, dissolved materials in the water can precipitate and/or deposit in the waterside of the boiler. These include materials such as oxides, hydroxides, hydrates, carbonates, and other organic/chemical impurities. These deposits can result in the formation of scale on the insides of tube surfaces, or can facilitate corrosion of structural materials within the boiler system. These deposits and/or corrosion combined with the high heat fluxes found in the furnace section of a boiler may lead to tube failures. While scale/deposits can be removed using various maintenance and clean-up processes, this leads to downtime.

Typical systems for supplying high-pressure high-temperature steam to various processes generally involve the direct heating of the feedwater in the boiler. High purity feedwater is typically required to avoid scale/deposits within the tubes of the boiler, other devices associated with the system, and the piping in fluid communication therewith. Low quality feedwater can be treated/cleaned to obtain high purity feedwater. While this is acceptable in a closed loop where the treated high purity feedwater is recycled through the boiler, the treatment/clean-up of the feedwater becomes prohibitively expensive in an open loop cycle because the feedwater treatment system would need to continuously produce high purity water at a rate that is equal to the steam flow requirement of the process. Otherwise, the heat flux in the boiler tubes caused by using low quality feedwater would result in deposits/accumulation of impurities.

However, not all commercial processes that require high-pressure steam also require the steam be at as high a level of purity as the feedwater for a boiler system. It would be desirable to provide systems and methods that can produce high-pressure steam without the concurrent need to continuously produce or use high quality feedwater, and without increasing boiler downtime or maintenance.

BRIEF DESCRIPTION

The present disclosure relates to a system for producing high pressure steam from low quality feedwater for a designated process. The system includes a first closed loop piping system in fluid communication with a boiler and a heat exchanger assembly. A first fluid is provided within the first closed loop piping system, and a portion of the first fluid exits the boiler as high-temperature steam having a boiler output temperature. A second loop piping system for the designated process is in fluid communication with the heat exchanger assembly, and contains the low quality feedwater. The heat from the first fluid is transferred to the low quality feedwater through the heat exchanger. The first piping system and second piping system are not in fluid communication, i.e. the first fluid and the low quality feedwater do not mix together.

Disclosed in some embodiments are systems for producing high-pressure steam from low quality feedwater, comprising: a first closed loop containing a first fluid, the first closed loop containing a boiler and a heat exchanger assembly downstream of the boiler, wherein at least a portion of the first fluid exits the boiler as a high-temperature steam having a boiler output temperature; and a second loop in fluid communication with the heat exchanger assembly, the second loop containing the low quality feedwater; wherein the heat exchanger assembly is adapted to receive the first fluid from the boiler and transfer heat from the first fluid to the low quality feedwater in the second loop so that the low quality feedwater exits the heat exchanger assembly as a high-pressure steam and the first fluid exits the heat exchanger assembly as a condensed steam having a heat exchanger discharge temperature.

The heat exchanger assembly may include a plurality of heat exchangers. Those heat exchangers can be arranged in series or parallel. In particular embodiments, at least two heat exchangers in the plurality of heat exchangers are arranged in parallel.

The low quality feedwater can exit the heat exchanger assembly as supercritical steam.

The first closed loop can further comprise a deaerator downstream of the heat exchanger assembly for treating the condensed steam prior to reintroducing the first fluid into the boiler. The system may include a bypass segment directly connecting the boiler and the deaerator. The first fluid in the bypass segment may be in the form of saturated steam. The first closed loop can also further comprise a make-up feedwater system for providing additional first fluid.

In particular embodiments, the boiler output temperature of the first fluid is at least 100° F. greater than the temperature of the low-quality feedwater exiting the heat exchanger assembly.

Also disclosed herein are methods for producing high-pressure steam from low quality feedwater, comprising: heating a first fluid in a boiler, wherein at least a portion of the first fluid exits the boiler as a high-temperature steam having a boiler output temperature; sending the high-temperature steam to a heat exchanger assembly, the boiler and the heat exchanger assembly forming a first closed loop; and sending the low quality feedwater to the heat exchanger assembly, the low quality feedwater being in a second loop separate from the first closed loop, wherein heat is transferred from the first fluid to the low quality feedwater so that the low quality fluid exits the heat exchanger assembly as a high-pressure steam and the first fluid exits the heat exchanger assembly as a condensed steam having a heat exchanger discharge temperature.

In particular embodiments, the low quality feedwater exits the heat exchanger assembly as supercritical steam.

Some methods further comprise sending the condensed steam in the first closed loop exiting the heat exchanger assembly to a deaerator for treatment prior to reintroducing the first fluid into the boiler. First fluid can also be sent from the boiler directly to the deaerator through a bypass segment. The first fluid in the bypass segment can be in the form of saturated steam.

The methods can further comprise providing additional first fluid to the first closed loop using a make-up feedwater system.

In embodiments, the boiler output temperature of the first fluid is at least 100° F. greater than the temperature of the low-quality feedwater exiting the heat exchanger assembly.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
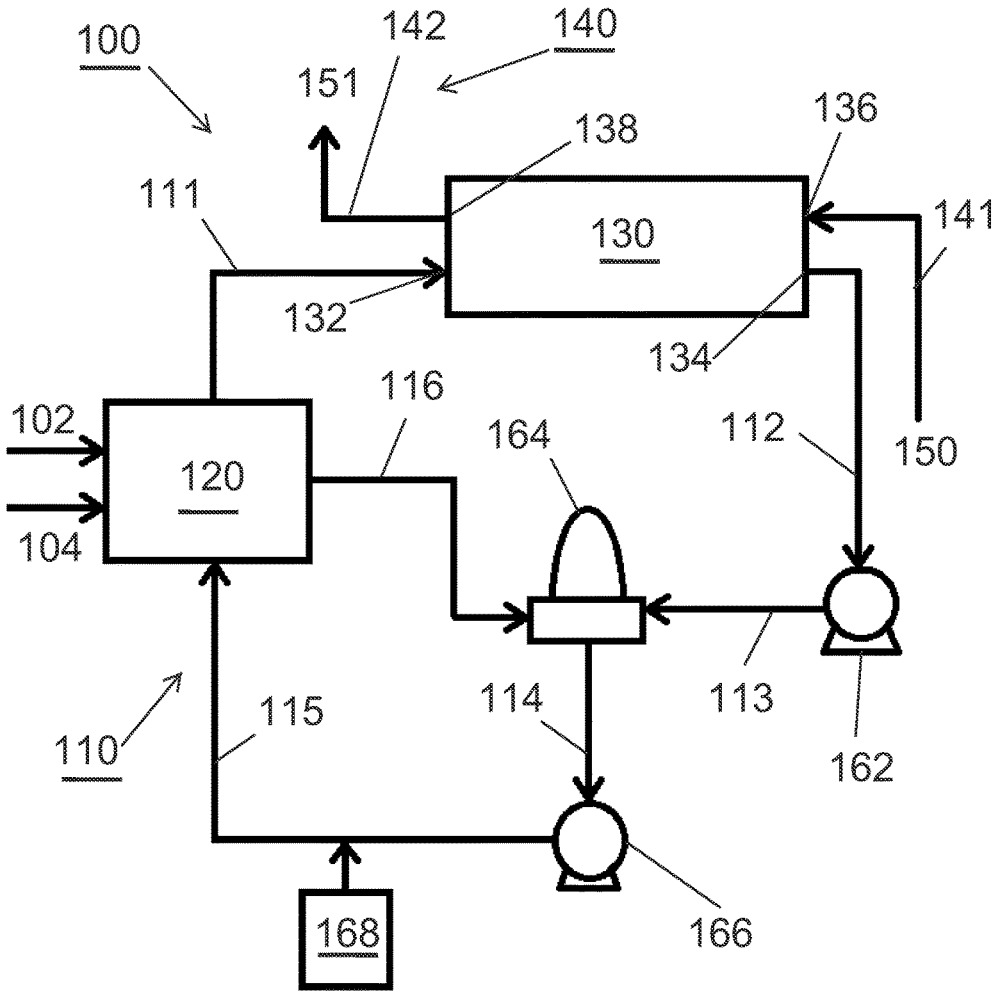
FIG. 1 is a flowchart showing the high-pressure steam generation system of the present disclosure. A first closed loop runs through a boiler and a heat exchanger assembly. A second loop that uses low quality feedwater also runs through the heat exchanger assembly.

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of."

Numerical values should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 watts to 10 watts" is inclusive of the endpoints, 2 watts and 10 watts, and all the intermediate values).

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

The terms "waterside", "water cooled", "steam cooled" or "fluid side" refer to any area of the boiler that is exposed to water or steam. In contrast, the terms "airside", "gas side" or "fireside" refer to an area of the boiler that is exposed to direct heat from the furnace, or in other words the combustion air from the furnace. Where the specification refers to water and/or steam, the liquid and/or gaseous states of other fluids may also be used in the methods of the present disclosure.

The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow fluids through an upstream component prior to flowing through the downstream component. It should be noted that in a loop, a first component can be described as being both upstream of and downstream of a second component.

As used herein, the term "supercritical" refers to a fluid that is at a temperature above its critical temperature and at a pressure above its critical pressure. For example, the critical temperature of water is 374.15° C. (705° F.), and the critical pressure of water is 3200.1 psia (22.1 MPa). A fluid at a temperature that is above its critical temperature at a given pressure but is below its critical pressure is considered to be "superheated" but "subcritical". A superheated fluid can be cooled (i.e. transfer energy) without changing its phase. As used herein, the term "wet steam" refers to a saturated steam/water mixture (i.e., steam with less than 100% quality where quality is percent steam content by mass). As used herein, the term "dry steam" refers to steam having a quality equal to greater than 100% (i.e., no liquid water is present). Supercritical water or steam will have no visible bubble interface or meniscus forming during a heating or cooling process due to zero surface tension on reaching the critical point temperature. The fluid continues to act like a single phase flow while converting from water to steam or steam to water, and is a non-equilibrium thermodynamic condition where rapid changes in density, viscosity and thermal conductivity can occur.

To the extent that explanations of certain terminology or principles of the boiler and/or steam generator arts may be necessary to understand the present disclosure, the reader is referred to *Steam/its generation and use,* 40th Edition, Stultz and Kitto, Eds., Copyright 1992, The Babcock & Wilcox Company, and to *Steam/its generation and use,* 41st Edition, Kitto and Stultz, Eds., Copyright 2005, The Babcock & Wilcox Company, the texts of which are hereby incorporated by reference as though fully set forth herein.

The present disclosure relates to systems and methods for generating high-pressure steam for a designated process, up to and including supercritical steam, using a low quality feedwater source without the need to treat large quantities of water on a continuous basis. The high-pressure steam is produced by passing the low quality feedwater through a heat exchanger assembly. There, heat energy from a high-temperature steam flow is transferred to the low quality feedwater. This arrangement minimizes the amount of effort spent on maintenance as deposits (e.g. scale) generally occur more in the heat exchanger assembly rather than in the boiler, as would occur if the low quality feedwater were directly heated by the boiler. This also minimizes the major expenses associated with the installation and operation of a high-volume high-purity water cleanup system that would otherwise be needed. The boiler water and steam cycle is decoupled from the process steam cycle.

FIG. 1 illustrates an exemplary embodiment of the steam generation system of the present disclosure. The steam generation system 100 includes a first loop 110 or piping arrangement. The first loop includes a boiler 120 and a heat exchanger assembly 130.

The heat exchanger assembly 130 is downstream of the boiler 120. The assembly includes a first fluid path and a second fluid path which are separate from each other, or in other words fluid in the first fluid path will not mix with fluid in the second fluid path. The two fluid paths are generally made to permit heat transfer from one fluid path to the other fluid path, e.g. in counter-current flow or cross-current flow patterns. The first fluid path has a first inlet 132 and a first outlet 134. The second fluid path also has a second inlet 136 and a second outlet 138.

Pipe 111 connects the boiler 120 to the first inlet 132 of the heat exchanger assembly. Pipes 112 and 113 lead from the heat exchanger assembly 130 through a condensate pump 162 to a deaerator 164, with pipe 112 being connected to the first outlet 134 of the heat exchanger assembly. Pipes 114 and 115 lead from the deaerator 164 through a feedwater pump 166 back to the boiler 120. A make-up feedwater system 168 is shown here as feeding into pipe 115 upstream of the boiler 120. A bypass segment 116 also directly connects the boiler 120 to the deaerator 164.

The steam generation system also includes a second loop 140 or piping arrangement. The second loop includes a pipe 141 that carries low-quality feedwater source 150 to the second inlet 136 of the heat exchanger assembly 130. Pipe 142 connects to the second outlet 138, and carries high-pressure steam from the heat exchanger assembly to the designated process for use.

In use, fuel 102 and air 104 are fed to the boiler 120, and used to convert a first fluid in the first closed loop 110 into steam of desired quality (e.g. saturated, superheated, supercritical, etc.). In this regard, the boiler 120 should be understood to include economizer, reheater, and superheater surfaces that can be used to obtain the desired pressure and temperature of the resulting steam to be sent to the heat exchanger assembly.

Two possible steam outlets are depicted from the boiler 120. The first outlet is designated using pipe 111, and carries high temperature steam to the heat exchanger assembly 130. The second outlet is designated using pipe 116, and bypasses the heat exchanger assembly 130, and is shown here connecting directly to deaerator 164. Pipe 116 carries saturated or slightly superheated steam and is generally used when the desired heat load passing through pipe 111 is reduced or minimized. In the deaerator 164, dissolved gases are removed from the received steam, and the steam/water is returned to the boiler through pipes 114 and 115. The first fluid circulating in the first closed loop is generally high-purity (i.e. high-quality) water. Thus, the first closed loop 110 could also be described as containing two sub-loops. The first sub-loop runs through boiler 120, pipe 111, heat exchanger assembly 130, pipe 112, pump 162, pipe 113, deaerater 164, pipe 114, pump 166, and pipe 115. The second sub-loop runs through boiler 120, pipe 116, deaerator 164, pipe 114, pump 166, and pipe 115, The second loop 140 uses low-quality feedwater. This low-quality feedwater 150 passes to heat exchanger assembly 130, where the feedwater is converted into high-pressure steam by transferring the heat energy from the first closed loop (carried by pipe 111) to the low quality feedwater. The temperature of the high-temperature steam entering through pipe 111 is greater than the temperature of the high-pressure steam exiting through pipe 142, the difference being established by accepted heat exchanger design practice, heat transfer and thermodynamic principles. In particular embodiments, the temperature of the high-temperature steam entering through pipe 111 is at least 100° F. greater than the temperature of the high-pressure steam exiting through pipe 142.

The high-pressure steam then exits in pipe 142 to be used in process 151. The high-pressure steam 142 may be used in the process, and may then be recycled back through the heat exchanger assembly 130, or low-quality feedwater can be continuously obtained from a feedwater source and consumed in the process 151. The high-temperature steam 111 in the first closed loop exits the heat exchanger assembly 130 as condensed steam in pipe 112, and is recycled through boiler 120 as previously described. Again, the first fluid in the first closed loop does not mix with the low-quality feedwater in the second loop; they are kept separate, and heat is transferred between them through the heat exchanger assembly.

The heat exchanger assembly 130 can include more than one heat exchanger, i.e. a plurality of heat exchangers. It is contemplated that those heat exchangers can be organized in series, or can be organized into two or more parallel streams. Parallel streams permit heat exchange to continue through one stream of heat exchangers while another stream of heat exchangers undergoes maintenance.

In particular embodiments, it is contemplated that the heat exchangers in the heat exchanger assembly 130 are tube-shell heat exchangers, in which the high-quality feedwater of the first closed loop passes through the shell-side and the low-quality feedwater passes through the tube-side of the heat exchangers (i.e. counter-flow to each other). It is contemplated that any scale/deposits which occurs due to the low-quality feedwater would occur in the tubes of the heat exchanger(s). The tubes of the heat exchanger assembly are easier to clean/maintain compared to the tubes in the boiler itself (e.g. easier to obtain physical access to the tubes or to replace the tubes without needing to shut down the entire system).

Figure 2:
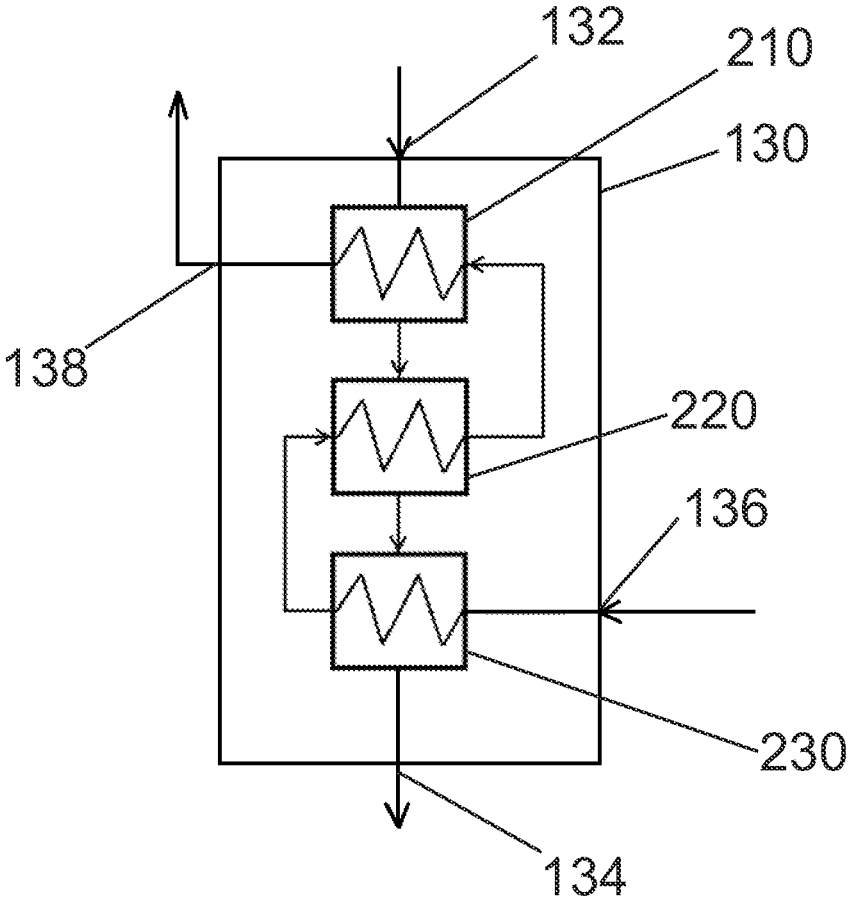
FIG. 2 is an exemplary illustration of a heat exchanger assembly containing heat exchangers arranged in series.

FIG. 2 illustrates an exemplary heat exchanger assembly 130 containing heat exchangers 210, 220, and 230 arranged in series. The first inlet 132, first outlet 134, second inlet 136, and second outlet 138 of the two fluid paths are also labeled.

Figure 3:
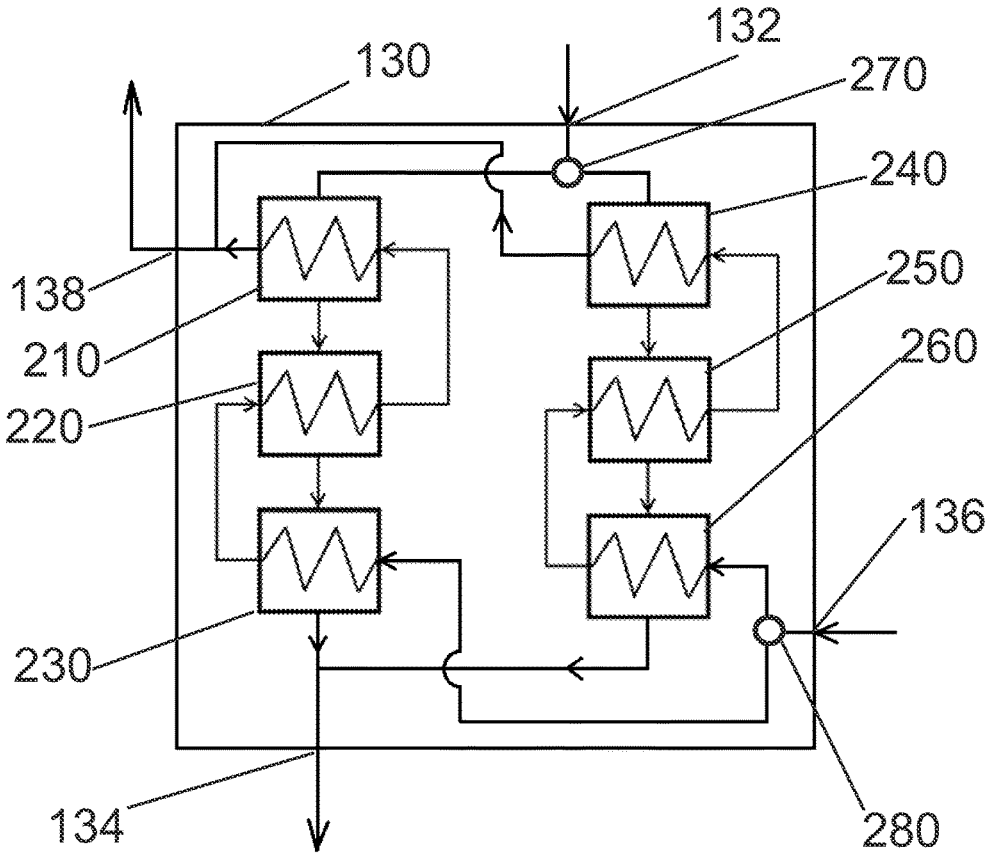
FIG. 3 is an exemplary illustration of a heat exchanger assembly containing heat exchangers arranged in parallel.

FIG. 3 illustrates an exemplary heat exchanger assembly 130 containing six heat exchangers 210, 220, 230, 240, 250, and 260. The heat exchangers are arranged into two parallel streams, with each stream containing three heat exchangers arranged in series. Valves 270, 280 control the fluid flow. It is contemplated that fluid flow can proceed through both streams concurrently, or one stream at a time (with the heat exchangers in the other stream undergoing maintenance).

The first inlet 132, first outlet 134, second inlet 136, and second outlet 138 of the two fluid paths are also labeled. These two figures are intended to be exemplary, and other arrangements are contemplated to be within the scope of the present disclosure.

The boiler 120 can generally be any type of boiler, such as a fuel-fired boiler, an electric boiler, a supercritical boiler, a solar boiler, a nuclear boiler, etc. Suitable examples of the boiler include the FM boiler, PFI boiler, PFT boiler, and TSSG boilers offered by Babcock & Wilcox. The FM boiler can generate a steam flow of 10,000 to 260,000 lbs/hour, a steam temperature up to 850° F. (454° C.) depending on the fuel source, and a steam pressure up to 1250 psig (8.62 MPa). The PFI boiler can generate a steam flow of 100,000 to 700,000 lbs/hour, a steam temperature up to 960° F. (516° C.), and a steam pressure up to 1150 psig (7.9 MPa). The PFT boiler can generate a steam flow of 350,000 to 800,000 lbs/hour, a steam temperature up to 1000° F. (538° C.), and a steam pressure up to 1800 psig (12.4 MPa). The TSSG boiler can generate a steam flow of 300,000 to 1.2 million lbs/hour, can generate superheated steam, and provide an operating steam pressure from 600 psig (4.14 MPa) up to 2,000 psig (13.8 MPa).

In particular embodiments, the steam exiting the boiler through pipe 111 is a low-pressure high-temperature steam flow. This steam flow in pipe 111 may have a pressure of from about 50 psig to about 1800 psig and a temperature of from about 600° F. to about 1000° F.

Similarly, in particular embodiments the steam in the second loop 140 exiting the heat exchanger assembly through pipe 142 is a high-pressure high-temperature steam flow, i.e. supercritical. This steam flow in pipe 142 may have a pressure of 3200.1 psia (22.1 MPa) or higher, and a temperature of 374.15° C. or higher.

The first fluid located in the first closed loop 110 is high-quality, and the feedwater in the second loop 140 is low-quality. For reference, Table 1 provides a listing of the allowable limits of various materials in ultrapure (UP) water, typical requirements for industrial boilers, and potable water according to the Environmental Protection Agency (EPA).

TABLE 1

| Constituent | Ultra Pure Water | Industrial Boiler Water Requirements | EPA Potable Water |
|---|---|---|---|
| pH | 8.0-9.6 | 8.8-9.6 | 6.5-8.5 |
| Hydrazine | 0-20 ppb | — | — |
| Total Dissolved Solids (TDS) | 30 ppb | 25 ppm* | 500 ppm |
| Hardness | 3 ppb | 50 ppb | — |
| Organics | 100-200 ppb | 200 ppb | — |
| Sodium | 3-5 ppb | — | — |
| Oxygen | 7-150 ppb | 7 ppb | — |
| Silica | 10-20 ppb | — | — |
| Iron | 5-10 ppb | 20 ppb | 0.3 ppm |
| Copper | 0-2 ppb | 10 ppb | 1.3 ppm |

*assumes 1000 psi, 0.1 ppm solids in steam and 2% blowdown

It should be noted that the UltraPure water requirements are in parts per billion, whereas the EPA requires are in parts per million. Potable water is not clean/pure enough to be used as feedwater in a boiler. For the purposes of this application, "low-quality feedwater" is considered to be any fluid having more of a given constituent than permitted by the column entitled "Industrial Boiler Water Requirements." The fluid used in the first closed loop typically meets the requirements listed in the column entitled "Industrial Boiler Water Requirements" or "Ultra Pure Water", depending on the boiler used.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A system for producing high-pressure steam from low quality feedwater, comprising:

a first closed loop containing a first fluid, the first closed loop containing a boiler and a heat exchanger assembly downstream of the boiler, wherein at least a portion of the first fluid exits the boiler as a low-pressure high-temperature steam having a boiler output temperature of from about 600° F. to about 1000° F. and a pressure of from about 50 psig to about 1800 psig; and a second loop in fluid communication with the heat exchanger assembly, the second loop separate from the first closed loop and containing the low quality feedwater;

wherein the heat exchanger assembly includes a plurality of heat exchangers, each heat exchanger comprising a plurality of heat exchanger tubes, and wherein the heat exchanger assembly is adapted to receive the first fluid from the boiler and transfer heat from the first fluid to the low quality feedwater in the second loop so that the low quality feedwater exits the heat exchanger assembly as a supercritical steam at a temperature of at least 374° C. and a pressure of at least 3200 psia, and the first fluid exits the heat exchanger assembly as a condensed steam having a heat exchanger discharge temperature.

2. The system of claim 1, wherein at least two heat exchangers in the plurality of heat exchangers are arranged in parallel.

3. The system of claim 1, wherein the first closed loop further comprises a deaerator downstream of the heat exchanger assembly for treating the condensed steam prior to reintroducing the first fluid into the boiler.

4. The system of claim 3, further comprising a bypass segment directly connecting the boiler and the deaerator.

5. The system of claim 4, wherein the first fluid in the bypass segment is in the form of saturated steam.

6. The system of claim 1, wherein the first closed loop further comprises a make-up feedwater system for providing additional first fluid.

7. The system of claim 1, wherein the boiler output temperature of the first fluid is at least 100° F. greater than the temperature of the low-quality feedwater exiting the heat exchanger assembly.

8. The system of claim 1, wherein the plurality of heat exchangers are arranged in two parallel streams, each stream containing a plurality of heat exchangers arranged in series such that fluid flow can proceed through one parallel stream at a time.

9. The system of claim 1, wherein each heat exchanger is a tube-shell heat exchanger, the first fluid passing through a shell side thereof and the low quality feedwater through a tube side thereof, such that the first fluid and the low quality feedwater flow counter to one another.

10. The system of claim 1, wherein the first fluid is a high quality feedwater.

11. A method for producing high-pressure steam from low quality feedwater, the method comprising:

heating a first fluid in a boiler, wherein at least a portion of the first fluid exits the boiler as a low-pressure high-temperature steam having a boiler output temperature of from about 600° F. to about 1000° F. and a pressure of from about 50 psig to about 1800 psig;

sending the high-temperature steam to a heat exchanger assembly, the boiler and the heat exchanger assembly forming a first closed loop, the heat exchanger assembly including a plurality of heat exchangers, each heat exchanger comprising a plurality of heat exchanger tubes; and sending the low quality feedwater to the heat exchanger assembly, the low quality feedwater being in a second loop separate from the first closed loop, wherein heat is transferred from the first fluid to the low quality feedwater so that the low quality feedwater exits the heat exchanger assembly as a supercritical steam at a temperature of at least 374° C. and a pressure of at least 3200 psia, and the first fluid exits the heat exchanger assembly as a condensed steam having a heat exchanger discharge temperature.

12. The method of claim 11, wherein at least two heat exchangers in the plurality of heat exchangers are arranged in parallel.

13. The method of claim 11, further comprising sending the condensed steam in the first closed loop exiting the heat exchanger assembly to a deaerator for treatment prior to reintroducing the first fluid into the boiler.

14. The method of claim 13, further comprising sending first fluid from the boiler directly to the deaerator through a bypass segment.

15. The method of claim 14, wherein the first fluid in the bypass segment is in the form of saturated steam.

16. The method of claim 11, further comprising providing additional first fluid to the first closed loop using a make-up feedwater system.

17. The method of claim 11, wherein the boiler output temperature of the first fluid is at least 100° F. greater than the temperature of the low-quality feedwater exiting the heat exchanger assembly.

18. The method of claim 11, wherein the plurality of heat exchangers are arranged in two parallel streams, each stream containing a plurality of heat exchangers arranged in series such that fluid flow can proceed through one parallel stream at a time.

19. The method of claim 11, wherein each heat exchanger is a tube-shell heat exchanger, the first fluid passing through a shell side thereof and the low quality feedwater through a tube side thereof, such that the first fluid and the low quality feedwater flow counter to one another.

20. The method of claim 11, wherein the first fluid is a high quality feedwater.

* * * * *